US008824708B2

(12) United States Patent
Onishi et al.

(10) Patent No.: US 8,824,708 B2
(45) Date of Patent: Sep. 2, 2014

(54) OSCILLATION DEVICE AND ELECTRONIC APPARATUS

(75) Inventors: Yasuharu Onishi, Kanagawa (JP); Yuichiro Kishinami, Kanagawa (JP); Jun Kuroda, Kanagawa (JP); Yukio Murata, Kanagawa (JP); Shigeo Satou, Kanagawa (JP); Motoyoshi Komoda, Kanagawa (JP); Nobuhiro Kawashima, Kanagawa (JP); Tatsuya Uchikawa, Kanagawa (JP)

(73) Assignee: NEC Casio Mobile Communications, Ltd., Kanagawa (JP)

( * ) Notice: Subject to any disclaimer, the term of this patent is extended or adjusted under 35 U.S.C. 154(b) by 0 days.

(21) Appl. No.: 13/823,503

(22) PCT Filed: Sep. 9, 2011

(86) PCT No.: PCT/JP2011/005069

§ 371 (c)(1),
(2), (4) Date: Apr. 25, 2013

(87) PCT Pub. No.: WO2012/060045

PCT Pub. Date: May 10, 2012

(65) Prior Publication Data

US 2013/0216069 A1 Aug. 22, 2013

(30) Foreign Application Priority Data

Nov. 1, 2010 (JP) ..... 2010-245681

(51) Int. Cl.
*H04R 25/00* (2006.01)

(52) U.S. Cl.
USPC ..... 381/190; 381/174; 381/182

(58) Field of Classification Search
USPC ..... 381/151, 173, 182, 190–191, 396
See application file for complete search history.

(56) References Cited

U.S. PATENT DOCUMENTS

| | | | | |
|---|---|---|---|---|
| 4,401,857 | A * | 8/1983 | Morikawa | 381/182 |
| 4,969,197 | A * | 11/1990 | Takaya | 381/190 |
| 6,453,050 | B1 * | 9/2002 | Ogura et al. | 381/190 |
| 2001/0033669 | A1 | 10/2001 | Bank et al. | |
| 2010/0246863 | A1 | 9/2010 | Onishi et al. | |

FOREIGN PATENT DOCUMENTS

| | | | |
|---|---|---|---|
| JP | 9-271098 | A | 10/1997 |
| JP | 2003-520540 | A | 7/2003 |
| JP | 2004-104481 | A | 4/2004 |
| WO | 2007/026736 | A1 | 3/2007 |
| WO | 2009/063905 | A1 | 5/2009 |

* cited by examiner

*Primary Examiner* — Suhan Ni
(74) *Attorney, Agent, or Firm* — Sughrue Mion, PLLC

(57) ABSTRACT

An oscillation device (100) includes a piezoelectric element (121), a vibrating member (122) which binds one surface of the piezoelectric element (121) and is formed of a metal material, a resin member (123) which holds an outer circumferential portion of the vibrating member (122), a piezoelectric element (111), a vibrating member (122) which binds one surface of the piezoelectric element (111), is overlapped with the vibrating member (121) and the resin member (123) when seen in a plan view, and is formed of a metal material, and a support member (140) which supports the resin member (123) and the vibrating member (112), wherein at least one opening (150), which connects a space (170) positioned between the vibrating member (121) and the resin member (123), and the vibrating member (122) to the outside of the space (170), is provided in at least one of the vibrating member (121), the resin member (123), and the vibrating member (112).

9 Claims, 7 Drawing Sheets

OSCILLATION DEVICE AND ELECTRONIC APPARATUS

CROSS REFERENCE TO RELATED APPLICATIONS

This application is a National Stage of International Application No. PCT/JP2011/005069 filed on Sep. 9, 2011, which claims priority from Japanese Patent Application No. 2010-245681, filed on Nov. 1, 2010, the contents of all of which are incorporated herein by reference in their entirety.

TECHNICAL FIELD

The present invention relates to an oscillation device which includes a piezoelectric element, and an electric apparatus.

BACKGROUND ART

Recently, a thin and stylish mobile phone, which has a sound function such as a video telephone, moving image reproduction, or a handsfree telephone function having a commercial value, has been actively developed. Thereby, an electro-acoustic transducer, which is mounted on a mobile phone or the like, is also required to be small in the size and to reproduce sound with a very loud volume. Moreover, from the standpoint of privacy protection, development of an ultra-directional speaker, in which a sound field can be formed in only a specific position, is required. As the ultra-directional speaker, a parametric speaker, which demodulates modulated ultrasonic waves by a nonlinear state in air, has been developed.

The parametric speaker oscillates an ultrasonic wave oscillator by a single frequency. Thereby, it is preferable that the speaker be configured by a structure having a high mechanical quality factor. Therefore, energy is concentrated near a resonance frequency, and a sound can be reproduced with high efficiency.

Currently, various mobile phones are suggested as the above-described mobile phone (Patent Document 1).

RELATED DOCUMENT

Patent Document

[Patent Document 1] Pamphlet of International Publication WO. 2007/026736

DISCLOSURE OF THE INVENTION

As described above, when the mechanical quality factor of the oscillation device is high, a sound can be reproduced with high efficiency.

On the other hand, when the mechanical quality factor of the oscillation device is high, the following problems occur. In the case where the mechanical quality factor of the oscillation device is high, if the resonance frequency of the oscillation device is slightly dispersed in the manufacturing stage, a sound pressure level which the oscillation device can reproduce is remarkably changed. Thereby, in order to manufacture the oscillation device which has stable characteristics, large man-hours in adjustment of manufacturing conditions, inspection, or the like are required. Accordingly, when the mechanical quality factor of the oscillation device is high, productivity of the oscillation device may be decreased.

The present invention is made in consideration of the above-described problems, and an object thereof is to provide an oscillation device capable of adjusting a mechanical quality factor Q according to a use.

According to the present invention, there is provided an oscillation device including:

a first piezoelectric element;

a first vibrating member which binds one surface of the first piezoelectric element and is formed of a metal material;

a resin member which holds an outer circumferential portion of the first vibrating member;

a second piezoelectric element;

a second vibrating member which binds one surface of the second piezoelectric element, is overlapped with the first vibrating member and the resin member when seen in a plan view, and is formed of a metal material; and a support member which supports the resin member and the second vibrating member, wherein at least one opening, which connects a space positioned between the first vibrating member and the resin member, and the second vibrating member to the outside of the space, is provided in at least one of the first vibrating member, the resin member, and the second vibrating member.

According to the present invention, there is provided an electronic apparatus which includes the above-described oscillation device and an oscillating drive unit which makes the oscillation device output sound waves.

According to the present invention, it is possible to provide an oscillation device capable of adjusting a mechanical quality factor Q according to a use.

BRIEF DESCRIPTION OF THE DRAWINGS

The above-described object, other objects, characteristics, and advantages will become more obvious according to a preferred embodiment described below and the accompanying drawings.

DESCRIPTION OF EMBODIMENTS

Figure 1:
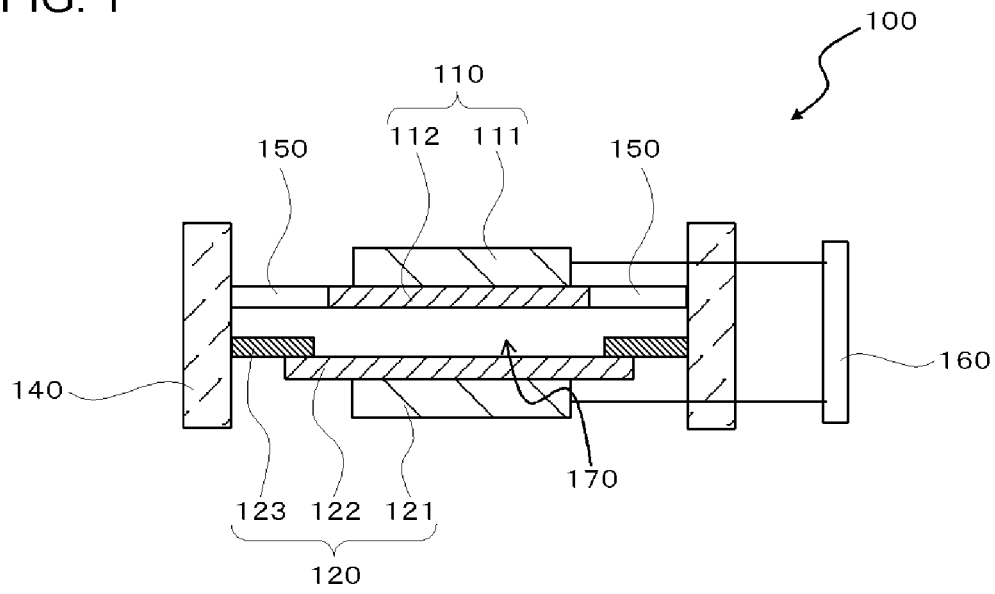
FIG. 1 is a schematic longitudinal cross-sectional front view showing an oscillation device according to the present embodiment.

An embodiment of the present invention will be described below with reference to the drawings. FIG. 1 is a schematic longitudinal cross-sectional front view showing an oscillation device 100 according to the present embodiment.

As shown in FIG. 1, the oscillation device 100 according to the present embodiment includes: a piezoelectric element 121; a vibrating member 122 which binds one surface of the piezoelectric element 121 and is formed of a metal material; a resin member 123 which holds an outer circumferential portion of the vibrating member 122; a piezoelectric element 111; a vibrating member 112 which binds one surface of the piezoelectric element 111, is overlapped with the vibrating member 122 and the resin member 123 when seen in a plan view, and is formed of a metal material; and a support member 140 which supports the resin member 123 and the vibrating member 112. At least one opening 150, which connects a space 170 positioned between the vibrating member 122 and the resin member 123, and the vibrating member 112 to the outside of the space 170, is provided in at least one of the vibrating member 122, a resin member 123, and the vibrating member 112.

Hereinafter, a configuration of the oscillation device 100 according to the present embodiment will be described in detail.

Figure 3:
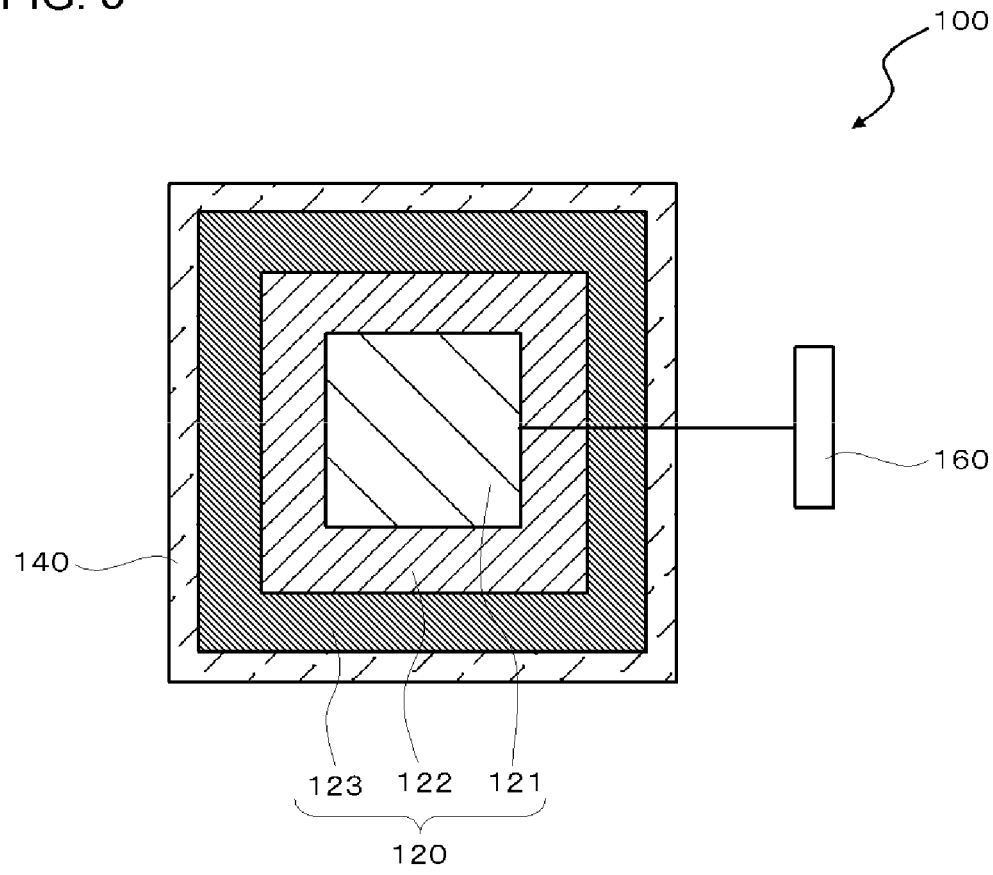
FIG. 3 is a bottom view showing the oscillation device shown in FIG. 1.

FIG. 3 is a bottom view showing the oscillation device 100 shown in FIG. 1. FIG. 3 shows a planar structure of an oscillator 120 which includes the piezoelectric element 121, the vibrating member 122, and the resin member 123.

As shown in FIG. 3, for example, the planar shape of the piezoelectric element 121 is a rectangle. Moreover, the planar shape of the piezoelectric element 121 is not limited to this, and for example, may be a circle or the like. The vibrating member 122 binds one surface of the piezoelectric element 121. The vibrating member 122 is formed of a metal material. For example, the planar shape of the vibrating member 122 is a rectangle. In addition, the planar shape of the vibrating member 122 is not limited to this, and for example, may be a circle or the like.

The resin member 123 holds the outer circumferential portion of the vibrating member 122. For example, the planar shape of the resin member 123 is a rectangular annular shape which has an opening in a region including a center. The vibrating member 122 is held by the resin member 123 so as to close the opening provided in the center of the resin member 123. The resin member 123 is configured by a resin material.

The support member 140 fixes the outer circumferential portion of the resin member 123, and thus, supports the resin member 123. For example, the support member 140 is provided in a tubular shape which is formed in a rectangle when seen in a plan view. Moreover, for example, the support member 140 is configured by a metal having high stiffness.

Figure 2:
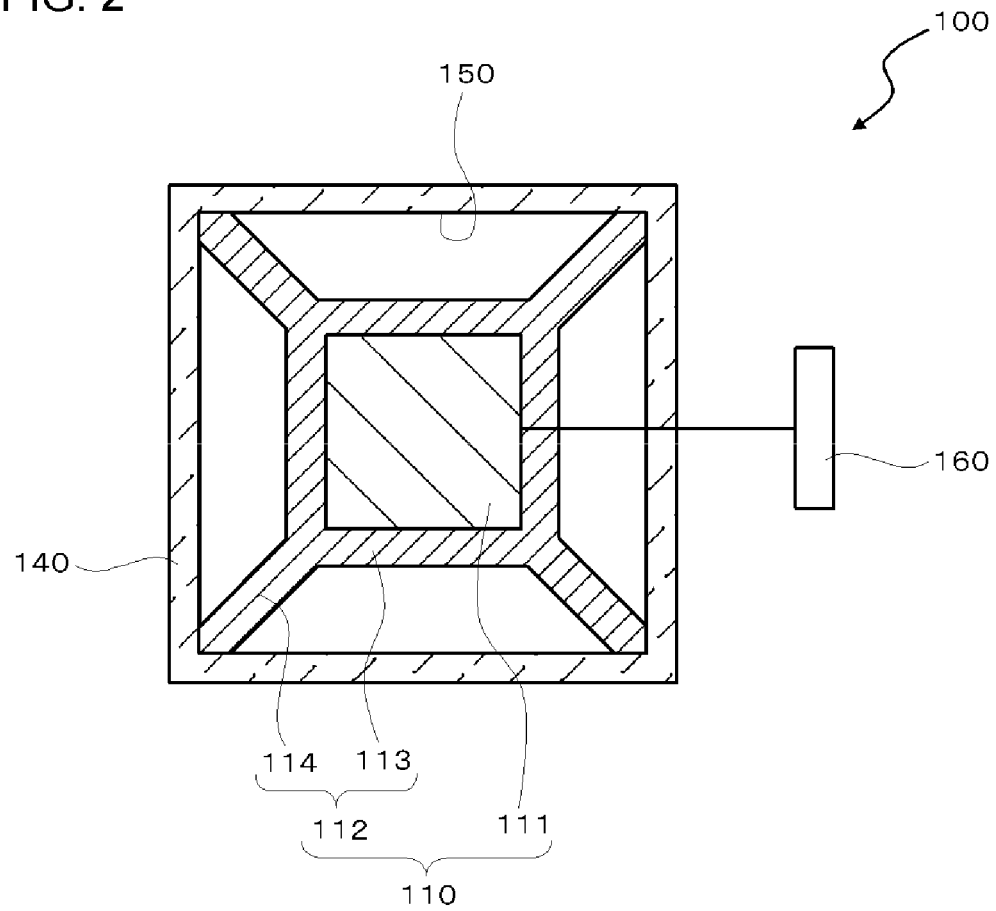
FIG. 2 is a plan view showing the oscillation device shown in FIG. 1.

FIG. 2 is a plan view showing the oscillation device 100 shown in FIG. 1. FIG. 2 shows a planar structure of an oscillator 110 which includes the piezoelectric element 111 and the vibrating member 112.

As shown in FIG. 2, for example, the planar shape of the piezoelectric element 111 is a rectangle. In addition, the planar shape of the piezoelectric element 111 is not limited to this, and for example, may be a circle or the like.

As shown in FIG. 2, the vibrating member 112 includes a base portion 113 which binds the piezoelectric element 111, and a beam portion 114 which connects the base portion 113 to the support member 140. Moreover, the vibrating member 112 includes an opening 150. For example, the planar shape of the base portion 113 is a rectangle. In addition, the planar shape of the base portion 113 is not limited to this, and for example, may be a circle or the like. The beam portion 114 connects a portion of the outer circumference of the base portion 113 to the support member 140. Thereby, the base portion 113 is supported to the support member 140. Moreover, a portion, in which the beam portion 114 is not provided in the region between the base portion 113 and the support member 140, becomes the opening 150.

As shown in FIG. 2, the planar shape of the base portion 113 is a rectangle. For example, the support member 140 is provided in a tubular shape which is formed in a rectangle when seen in a plan view. Moreover, the beam portion 114 is formed in an X shape which connects four corners of the base portion 113 and the four corners of the support member 140. Thereby, four openings 150 which become trapezoids when seen in a plan view are formed in the vibrating member 112.

The oscillation device 100 according to the present embodiment functions as a portion of an electronic apparatus such as a mobile phone (not shown in the drawings). Thereby, a driver circuit 160, which is an oscillating drive unit which makes the oscillation device 100 output sound waves, is provided in the electronic apparatus which includes the oscillation device 100. The driver circuit 160 is connected to the piezoelectric element 111 and the piezoelectric element 121, which are included in the oscillation device 100, through a lead wire or the like.

In the present embodiment, for example, the oscillating frequency of the oscillator 110 and the oscillator 120 is equal to or more than 20 kHz. For example, the oscillator 110 and the oscillator 120 output ultrasonic waves which are modulated for a parametric speaker. Moreover, for example, the oscillator 110 and the oscillator 120 may be configured so as to output sound waves having frequency of an audible range.

In the oscillation device 100 according to the present embodiment, the oscillator 110 and the oscillator 120 are driven to the driver circuit 160 and outputs ultrasonic waves which are modulated for a parametric speaker.

At this time, the ultrasonic waves which the oscillator 120 outputs to the oscillator 110 side are output to the outside (the upper side in FIG. 1) of the space 170 through the opening 150 from the space 170. Accordingly, a sound which is demodulated by the ultrasonic waves which are output from the oscillator 120 toward the oscillator 110 side (the upper side in FIG. 1), and a sound which is modulated by ultrasonic waves which are output from the oscillator 110 toward the side (the upper side in FIG. 1) opposite to the oscillator 120 are synthesized with each other.

As shown in FIG. 2, the oscillator 110 is configured by the piezoelectric element 111, and the vibrating member 112 which binds one surface of the piezoelectric element 111 and is formed of a metal material.

On the other hand, as shown in FIG. 3, the oscillator 120 is configured by a piezoelectric element 121, the vibrating member 122 which binds one surface of the piezoelectric element 121 and is formed of a metal material, and the resin member 123 which holds the vibrating member 122.

Figure 4:
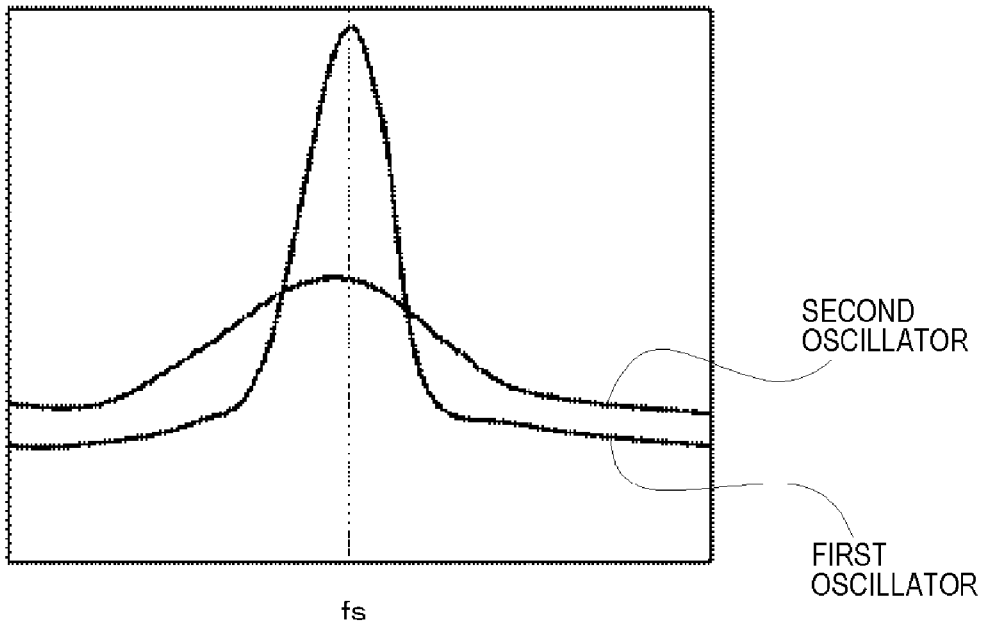
FIG. 4 is a characteristic diagram showing a mechanical quality factor Q of the oscillation device shown in FIG. 1.

Thereby, as shown in FIG. 4, in the oscillator 110 and the oscillator 120, mechanical quality factors Q are different from each other. As described above, the oscillator 110 is configured by a metal and a piezoelectric material. Thereby, the mechanical quality factor Q of the oscillator 110 is high. On the other hand, in the oscillator 120, the resin member 123 having a large internal loss is disposed in the end portion in which stress is concentrated at the time of vibration. Thereby, the vibration of the oscillator 120 is dampened by the resin member 123. Accordingly, compared to the oscillator 110, the mechanical quality factor Q of the oscillator 120 is low.

In this way, in the present embodiment, the oscillator 110 and the oscillator 120, which have mechanical quality factors Q remarkably different from each other, are provided in a single oscillator device 100. That is, as shown in FIG. 4, the oscillation device 100 according to the present embodiment includes the oscillator 110 and the oscillator 120 in which frequency characteristics of the sound pressure levels are different from each other.

Accordingly, in the present embodiment, the sounds, which are output from the oscillator 110 and the oscillator 120 having mechanical quality factors Q different from each other, are synthesized with each other. Thereby, it is possible to apparently adjust the mechanical quality factor Q of the oscillation device 100.

More specifically, as shown in FIG. 4, in the oscillator 110 having a high mechanical quality factor Q, a steep peak is observed in the frequency characteristics of the sound pressure level. On the other hand, as shown in FIG. 4, in the oscillator 120 having a low mechanical quality factor Q, compared to the oscillator 110, the frequency characteristics of the sound pressure level are flat.

If the sound of the oscillator 110 and the oscillator 120 is synthesized, the frequency characteristics of the sound pressure levels of the sound are averaged. That is, apparently, the mechanical quality factor Q of the oscillator device 100 has the value between the oscillator 110 and the oscillator 120.

In this way, the mechanical quality factor Q of the oscillation device 100 according to the present embodiment can be adjusted according to a use.

In addition, in the present embodiment, in a stage which outputs a sound, the mechanical quality factor Q of the oscillation device can be adjusted by adjusting an output ratio between the oscillator 110 and the oscillator 120. That is, by adjusting the output ratio between the oscillator 110 and the oscillator 120, the frequency characteristics of the sound pressure level of the sound which is output from the oscillator device 100 can be adjusted. Thereby, it is possible to apparently adjust the mechanical quality factor Q of the oscillator device 100.

Next, effects of the present embodiment will be described.

According to the present embodiment, the oscillation device 100 includes the oscillator 110 and the oscillator 120 which are overlapped with each other when seen in a plan view and in which the mechanical quality factors Q are different from each other. Moreover, in the vibrating member 112 which configures the oscillator 110, the opening 150, which connects the space 170 interposed between the oscillator 110 and the oscillator 120 to the outside of the space 170, is provided.

Thereby, the sounds, which are output from two oscillators in which the mechanical quality factors Q are different from each other, can be synthesized with each other. Therefore, it is possible to apparently adjust the mechanical quality factor Q of the oscillation device 100. Accordingly, the oscillation device which can adjust the mechanical quality factor Q according to a use can be provided.

By adjusting the mechanical quality factor Q of the oscillation device, a decrease of productivity of the oscillation device is suppressed, and sound reproduction can be realized with high efficiency.

Moreover, the present embodiment is not limited to the above-described aspect, and various modifications are allowed within a scope which does not depart from the gist. In the above-described aspect, the structure in which the opening 150 is formed in the vibrating member 112 configuring the oscillator 110 is exemplified.

Figure 5:
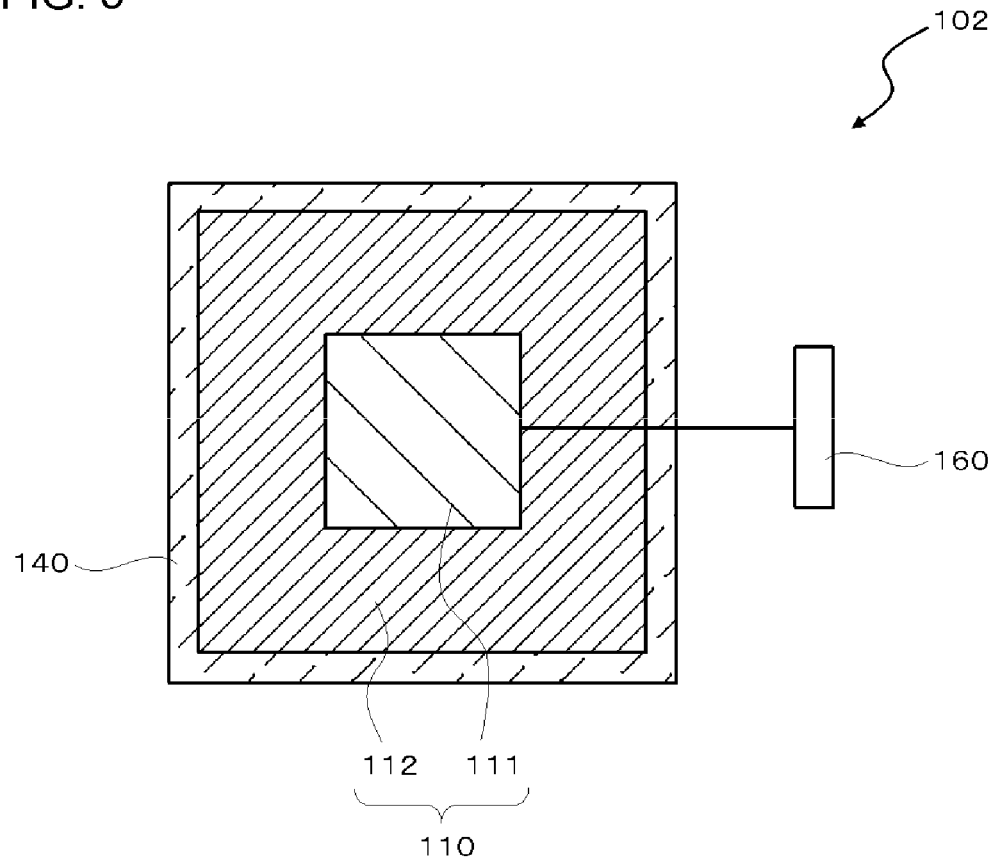
FIG. 5 is a plan view showing a first modification example of the oscillation device shown in FIG. 1.
Figure 6:
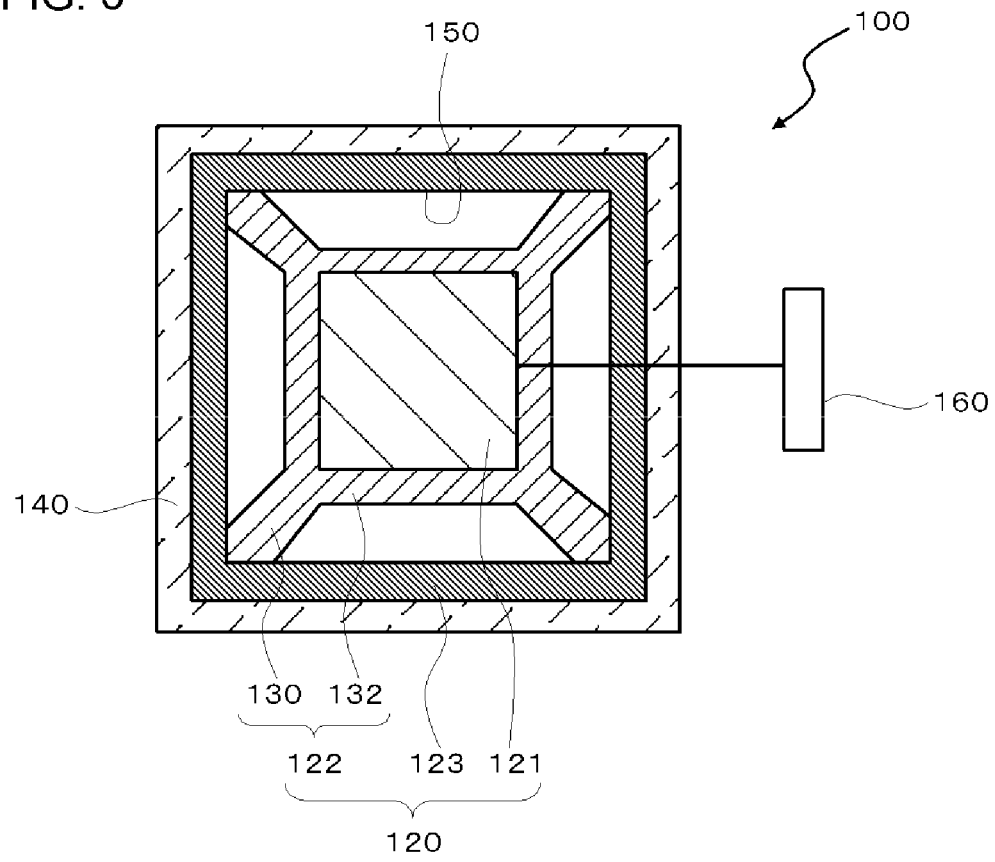
FIG. 6 is a bottom view showing the first modification example of the oscillation device shown in FIG. 1.

FIG. 5 is a plan view showing a first modification example of the oscillation device 100 shown in FIG. 1. Moreover, FIG. 6 is a bottom view showing the first modification example of the oscillation device 100 shown in FIG. 1. In the present embodiment, the structure shown in the first modification example may be provided.

In the oscillation device 100 according to the first modification example, the opening 150 is formed in the vibrating member 122. In the first modification example, as shown in FIG. 6, the vibrating member 122 includes a base portion 132 which binds the piezoelectric element 121, and a beam portion 130 which connects the base portion 132 to the resin member 123.

The beam portion 130 connects a portion of the outer circumference of the base portion 132 to the resin member 123. Thereby, the base portion 132 is held to the resin member 123. Moreover, a portion, in which the beam portion 130 is not provided in the region between the base portion 132 and the resin member 123, becomes the opening 150.

On the other hand, in the first modification example, as shown in FIG. 5, the opening 150 is not provided in the vibrating member 112.

In the first modification example, the ultrasonic waves which the oscillator 110 outputs to the oscillator 120 side are output to the outside of the space 170 through the opening 150 from the space 170. Accordingly, a sound which is demodulated by ultrasonic waves which are output from the oscillator 120 toward the side opposite to the oscillator 110, and a sound which is demodulated by the ultrasonic waves which are output from the oscillator 110 toward the oscillator 120 side are synthesized with each other.

Accordingly, similar to the above-describe shape, the mechanical quality factor Q of the oscillation device can be adjusted.

Figure 7:
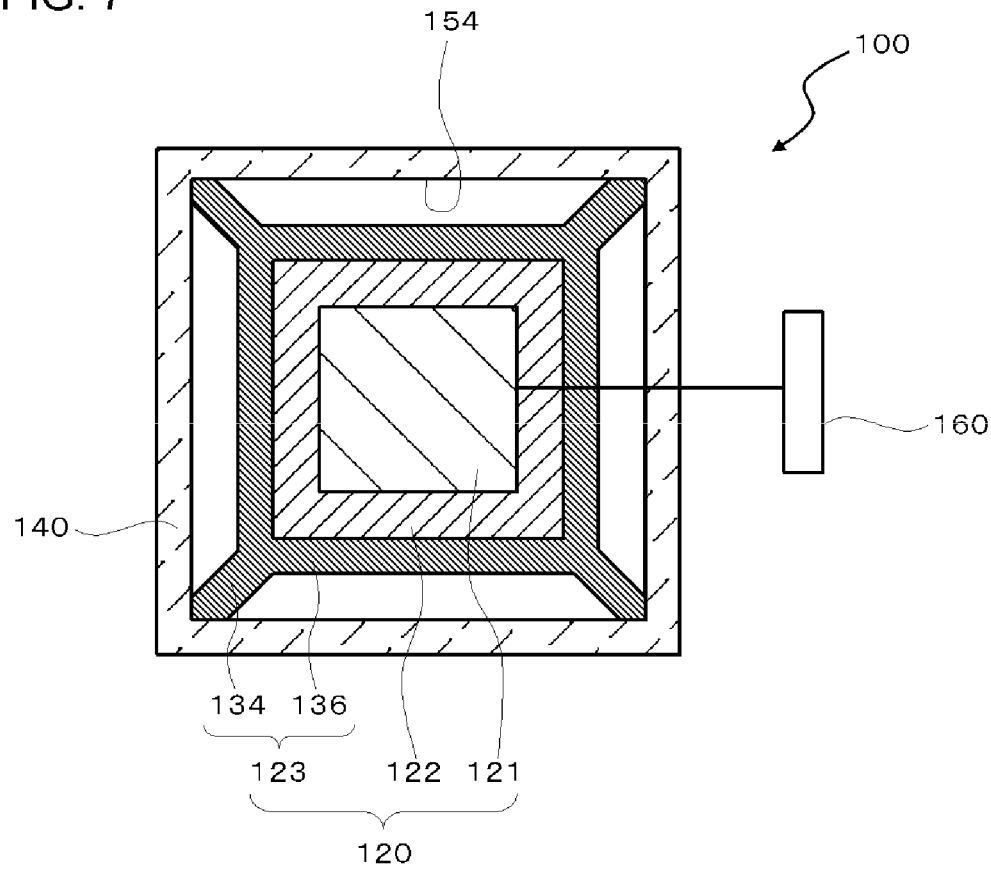
FIG. 7 is a bottom view showing a second modification example of the oscillation device shown in FIG. 1.

FIG. 7 is a bottom view showing a second modification example of the oscillation device 100 shown in FIG. 1. In the present embodiment, the structure shown in the second modification example may be provided.

In the oscillation device 100 according to the second modification example, the opening 150 is formed in the resin member 123. In the second modification example, as shown in FIG. 7, the resin member 123 includes a base portion 136 which holds the vibrating member 122, and a beam portion 134 which connects the base portion 136 to the support member 140.

The beam portion 134 connects a portion of the outer circumference of the base portion 136 to the support member 140. Thereby, the base portion 136 is supported to the support member 140. Moreover, a portion, in which the beam portion 134 is not provided in the region between the base portion 136 and the support member 140, becomes the opening 150.

On the other hand, similar to the first modification example, in the second modification example, the opening 150 is not provided in the vibrating member 112.

Also in the second modification example, similar to the first modification example, the mechanical quality factor Q of the oscillation device can be adjusted.

Moreover, in the present embodiment, the opening 150 may be provided in two members or more which are selected from the vibrating member 122, the resin member 123, and the vibrating member 112.

Also in this way, similar to the above-described aspect, it is possible to reproduce the sound, in which the sound demodulated by the ultrasonic waves output from the oscillator 110 and the sound demodulated by the ultrasonic waves output from the oscillator 120 are synthesized, from the oscillation device 100.

In addition, in the above-described aspects, the oscillation device 100 having a unimorph structure in which only one surface of the vibrating member is bounded by one piezoelectric element in the oscillator 110 and the oscillator 120, is exemplified. However, in at least one of the oscillator 110 and the oscillator 120, the oscillation device 100 of a bimorph structure, in which the upper surface and the lower surface of the vibrating member are bounded by two piezoelectric elements, or the like can be also realized (not shown in the drawings).

Moreover, the piezoelectric element 111 and the piezoelectric element 121 may be configured by one piezoelectric layer, and may be configured by a laminated structure in which piezoelectric layers and electrode layers are alternately laminated (not shown in the drawings).

Moreover, in the above-described aspects, the electronic apparatus in which the driver circuit 160 is connected to the oscillation device 100 is exemplified. However, an electric apparatus can be also realized, such as a sonar or the like which includes the oscillation device 100, an oscillating drive unit which makes the oscillation device 100 output ultrasonic waves for a sensor, a ultrasonic wave detection unit which detects the ultrasonic waves for the sensor reflected by an objected to be measured, and a distance measurement unit which calculates a distance from the oscillation device 100 to the object to be measured based on a time for the ultrasonic waves for the sensor are detected by the ultrasonic wave detection unit after the ultrasonic waves for the sensor are output from the oscillation device 100 (not shown in the drawings).

Moreover, understandably, the embodiment and the plurality of modification examples described above may be combined within a range in which the contents are not contrary. Moreover, in the embodiment and the modification examples described above, the structure or the like of each portion is specifically described. However, the structure or the like may be variously modified within a scope in which the present invention is satisfied.

This application claims priority based on Japanese Patent Application No. 2010-245681, filed Nov. 1, 2010, the content of which is incorporated herein by reference.

The invention claimed is:

1. An oscillation device comprising:

a first piezoelectric element;

a first vibrating member which binds one surface of the first piezoelectric element and is formed of a metal material;

a resin member which holds an outer circumferential portion of the first vibrating member;

a second piezoelectric element;

a second vibrating member which binds one surface of the second piezoelectric element, is overlapped with the first vibrating member and the resin member when seen in a plan view, and is formed of a metal material; and a support member which supports the resin member and the second vibrating member, wherein at least one opening, which connects a space positioned between the first vibrating member and the resin member, and the second vibrating member to the outside of the space, is provided in at least one of the first vibrating member, the resin member, and the second vibrating member.

2. The oscillation device according to claim 1, wherein a first oscillator which includes the first piezoelectric element and the first vibrating member, and a second oscillator which includes the second piezoelectric element, the second vibrating member, and the resin member output a modulated wave for a parametric speaker.

3. The oscillation device according to claim 1, wherein the first vibrating member includes the opening.

4. The oscillation device according to claim 3, wherein the first vibrating member includes a first base portion which binds the first piezoelectric element, and a first beam portion which connects the first base portion to the support member.

5. The oscillation device according to claim 1, wherein the second vibrating member includes the opening.

6. The oscillation device according to claim 5, wherein the second vibrating member includes a second base portion which binds the second piezoelectric element, and a second beam portion which connects the second base portion to the resin member.

7. The oscillation device according to claim 1, wherein the resin member includes the opening.

8. The oscillation device according to claim 7, wherein the resin member includes a third base portion which holds the second vibrating member, and a third beam portion which connects the third base portion to the support member.

9. An electronic apparatus comprising:

the oscillation device according to claim 1; and an oscillating drive unit which makes the oscillation device output sound waves.

* * * * *